US009427640B2

(12) United States Patent
Davis et al.

(10) Patent No.: US 9,427,640 B2
(45) Date of Patent: Aug. 30, 2016

(54) BALL BAT INCLUDING A STIFFENING ELEMENT IN THE BARREL

(71) Applicant: EASTON BASEBALL/SOFTBALL INC., Van Nuys, CA (US)

(72) Inventors: Stephen J. Davis, Van Nuys, CA (US); Dewey Chauvin, Simi Valley, CA (US); Ian Montgomery, Simi Valley, CA (US)

(73) Assignee: EASTON BASEBALL/SOFTBALL INC., Van Nuys, CA (US)

( * ) Notice: Subject to any disclaimer, the term of this patent is extended or adjusted under 35 U.S.C. 154(b) by 0 days.

(21) Appl. No.: 14/251,181

(22) Filed: Apr. 11, 2014

(65) Prior Publication Data

US 2015/0290510 A1 Oct. 15, 2015

(51) Int. Cl.

| | |
|---|---|
| ***A63B 59/51*** | (2015.01) |
| ***A63B 59/54*** | (2015.01) |
| ***A63B 59/06*** | (2006.01) |

(52) U.S. Cl.

CPC ..... *A63B 59/06* (2013.01); *A63B 59/50* (2015.10); *A63B 60/42* (2015.10); *A63B 59/51* (2015.10); *A63B 59/54* (2015.10); *A63B 2102/18* (2015.10); *A63B 2102/182* (2015.10)

(58) Field of Classification Search

CPC ..... A63B 2102/18; A63B 2102/182; A63B 59/50–59/58; A63B 59/581

USPC ..... 473/457, 519, 520, 564–568

See application file for complete search history.

(56) References Cited

U.S. PATENT DOCUMENTS

| | | | |
|---|---|---|---|
| 2,099,521 | A | 11/1937 | Herkimer et al. |
| 3,703,290 | A | 11/1972 | Wilson |
| 3,727,295 | A | 4/1973 | Gildemeister |
| 3,729,196 | A | 4/1973 | Heald, Jr. |
| 3,801,098 | A | 4/1974 | Gildemeister |
| 3,830,496 | A | 8/1974 | Reizer |
| 3,861,682 | A | 1/1975 | Fujii |
| 3,876,204 | A | 4/1975 | Moore et al. |
| 3,877,698 | A | 4/1975 | Volpe |
| 3,880,423 | A | 4/1975 | Kreag |
| 3,921,978 | A | 11/1975 | Warren |
| 3,963,239 | A | 6/1976 | Fujii |
| 4,014,542 | A | 3/1977 | Tanikawa |
| 4,032,143 | A | 6/1977 | Mueller et al. |
| 4,056,267 | A | 11/1977 | Krieger |
| 4,079,936 | A | 3/1978 | Schachter |
| 4,343,467 | A | 8/1982 | Newcomb et al. |
| 4,348,247 | A | 9/1982 | Loyd et al. |

(Continued)

OTHER PUBLICATIONS

United States Patent and Trademark Office, Search Report and Written Opinion for PCT/US09/69045, dated Mar. 2, 2010.

(Continued)

*Primary Examiner* — Mark Graham

(74) *Attorney, Agent, or Firm* — Perkins Coie LLP

(57) ABSTRACT

A ball bat includes a barrel in which one or more stiffening elements are located. The stiffening element may be positioned at a variety of locations, and may have a variety of configurations, for selectively limiting the barrel's performance without appreciably increasing the bat's moment of inertia. In one configuration, the stiffening element includes two radially outer flanges, a radially inner flange, and two web members connecting the outer flanges to the inner flange. The radially outer surfaces of the radially outer flanges contact, and may be affixed to, the inner surface of the barrel wall.

19 Claims, 1 Drawing Sheet

(56) References Cited

U.S. PATENT DOCUMENTS

| | | | | |
|---|---|---|---|---|
| 4,543,284 | A | 9/1985 | Baum | |
| 4,600,193 | A | 7/1986 | Merritt | |
| 4,746,117 | A | 5/1988 | Noble et al. | |
| 5,094,453 | A | 3/1992 | Douglas et al. | |
| 5,104,123 | A | 4/1992 | Okitsu et al. | |
| 5,180,163 | A | 1/1993 | Lanctot et al. | |
| 5,364,095 | A | 11/1994 | Easton et al. | |
| 5,393,055 | A | 2/1995 | McKay, Jr. | |
| 5,395,108 | A | 3/1995 | Souders et al. | |
| 5,458,330 | A | 10/1995 | Baum | |
| 5,533,723 | A | 7/1996 | Baum | |
| 5,575,722 | A | 11/1996 | Saia et al. | |
| 5,593,158 | A | 1/1997 | Filice et al. | |
| 5,624,115 | A | 4/1997 | Baum | |
| 5,759,113 | A | 6/1998 | Lai et al. | |
| 5,964,673 | A | 10/1999 | MacKay, Jr. | |
| 6,042,485 | A | 3/2000 | Cheng | |
| 6,042,493 | A | 3/2000 | Chauvin et al. | |
| 6,077,178 | A | 6/2000 | Brandt | |
| 6,152,840 | A | 11/2000 | Baum | |
| 6,334,824 | B1 | 1/2002 | Filice et al. | |
| 6,398,675 | B1 | 6/2002 | Eggiman et al. | |
| 6,497,631 | B1 | 12/2002 | Fritzke et al. | |
| 6,612,945 | B1 | 9/2003 | Anderson | |
| 6,729,983 | B1 | 5/2004 | Vakili et al. | |
| 6,755,757 | B2 | 6/2004 | Sutherland | |
| 6,869,372 | B1 | 3/2005 | Higginbotham et al. | |
| 6,872,156 | B2 | 3/2005 | Ogawa et al. | |
| 6,949,038 | B2 | 9/2005 | Fritzke | |
| 6,994,641 | B2 | 2/2006 | Hebreo et al. | |
| 7,011,588 | B2 | 3/2006 | Fritzke et al. | |
| 7,115,054 | B2 | 10/2006 | Giannetti et al. | |
| 7,534,179 | B1 * | 5/2009 | Vasek et al. | 473/566 |
| 7,850,554 | B2 | 12/2010 | Burger | |
| 7,867,114 | B2 * | 1/2011 | Sutherland et al. | 473/567 |
| 8,062,154 | B2 * | 11/2011 | Burger | 473/567 |
| 8,298,102 | B2 | 10/2012 | Chauvin et al. | |
| 8,435,143 | B2 | 5/2013 | Vander Pol et al. | |
| 8,449,412 | B2 | 5/2013 | Vander Pol et al. | |
| 8,632,428 | B2 * | 1/2014 | Burger | 473/566 |
| 2002/0151392 | A1 | 10/2002 | Buiatti et al. | |
| 2005/0070384 | A1 | 3/2005 | Fitzgerald et al. | |
| 2006/0025253 | A1 | 2/2006 | Giannetti et al. | |
| 2009/0029810 | A1 | 1/2009 | Fitzgerald et al. | |
| 2009/0143176 | A1 | 6/2009 | Burger | |
| 2009/0280934 | A1 | 11/2009 | Watari et al. | |
| 2010/0160095 | A1 | 6/2010 | Chauvin et al. | |
| 2011/0111894 | A1 | 5/2011 | Thouin | |
| 2011/0287875 | A1 | 11/2011 | Vander Pol et al. | |
| 2012/0184402 | A1 | 7/2012 | McNamee et al. | |
| 2013/0035181 | A1 | 2/2013 | Chauvin et al. | |

OTHER PUBLICATIONS

USPTO, "International Search Report and Written Opinion", for PCT/US15/25371, Jul. 13, 2015.

* cited by examiner

BALL BAT INCLUDING A STIFFENING ELEMENT IN THE BARREL

BACKGROUND

Baseball and softball governing bodies have imposed various bat performance limits over the years with the goal of regulating batted ball speeds. Each association generally independently develops various standards and methods to achieve a desired level of play. Bat designers typically comply with these performance standards by adjusting the performance, or bat-ball coefficient of restitution ("BBCOR"), of their bat barrels. Typical methods of controlling BBCOR include thickening the barrel wall of a hollow metal bat, or increasing the radial stiffness of a composite bat via the selection of specific materials and fiber angles. A composite bat's radial stiffness and fiber orientations are limited, however, by a given material thickness. The barrel walls in composite bats, therefore, are also often thickened to provide additional stiffness, which in turn limits BBCOR and barrel performance.

Thickening a barrel wall generally increases the bat's weight and, more importantly, it's "swing weight" or moment of inertia ("MOI"). MOI is the product of: (a) a mass, and (b) the square of the distance between the center of the mass and the point from which the mass is pivoted. Mathematically, this is expressed as follows:

$$MOI=\Sigma Mass\times(Distance)^2$$

Accordingly, the MOI dictates that it becomes increasingly difficult to swing a bat as the bat's mass increases or as the center of the bat's mass moves farther from the pivot point of the swing (i.e., farther from the batter's hands). Because thickening the barrel wall increases the bat's weight at a region relatively distal from the batter's hands, doing so also increases the bat's MOI. Thus, while thickening a barrel wall effectively stiffens the barrel and reduces its performance, the consequent increase in MOI is generally undesirable for batters.

SUMMARY

A ball bat includes a barrel in which one or more stiffening elements are located. The stiffening element may be positioned at a variety of locations, and may have a variety of configurations, for selectively limiting the barrel's performance without appreciably increasing the bat's moment of inertia. In one configuration, the stiffening element includes two radially outer flanges, a radially inner flange, and two web members connecting the outer flanges to the inner flange. The radially outer surfaces of the radially outer flanges contact, and may be affixed to, the inner surface of the barrel wall. Other features and advantages will appear hereinafter. The features described above can be used separately or together, or in various combinations of one or more of them.

DETAILED DESCRIPTION OF THE DRAWINGS

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

The embodiments described herein are directed to a ball bat having a limited bat-ball coefficient of restitution ("BBCOR"), or limited barrel performance, allowing the bat to perform within regulatory association performance limits. The National Collegiate Athletic Association ("NCAA"), for example, has proposed limiting a barrel's BBCOR to below 0.510 or below 0.500. Limiting of the BBCOR is preferably accomplished without appreciably increasing (or by decreasing) the ball bat's moment of inertia ("MOI").

Figure 1:
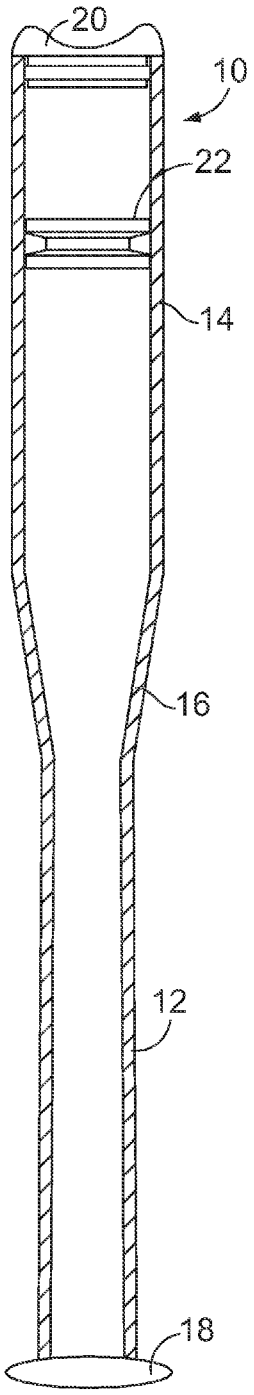
FIG. 1 is a side-sectional view of a ball bat, according to one embodiment.

Turning now in detail to the drawings, as shown in FIG. 1, a baseball or softball bat 10, hereinafter collectively referred to as a "ball bat" or "bat," includes a handle 12, a barrel 14, and a tapered section 16 joining the handle 12 to the barrel 14. The free end of the handle 12 includes a knob 18 or similar structure. The barrel 14 is preferably closed off by a suitable cap 20 or plug. The interior of the bat 10 is optionally hollow, allowing the bat 10 to be relatively lightweight so that ball players may generate substantial bat speed when swinging the bat 10. The ball bat 10 may be a one-piece construction or may include two or more separate attached pieces (e.g., a separate handle and barrel), as described, for example, in U.S. Pat. No. 5,593,158, which is incorporated herein by reference.

The ball bat 10 is preferably constructed from one or more composite or metallic materials. Some examples of suitable composite materials include fiber-reinforced glass, graphite, boron, carbon, aramid, ceramic, Kevlar, or Astroquartz®. Aluminum or another suitable metallic material may also be used to construct the ball bat 10. A ball bat including a combination of metallic and composite materials may also be constructed. For example, a ball bat having a metal barrel and a composite handle, or a composite barrel and a metal handle, may be used in the embodiments described herein.

The bat barrel 14 may include a single-wall or multi-wall construction. A multi-wall barrel may include, for example, barrel walls that are separated from one another by one or more interface shear control zones ("ISCZs"), as described in detail in U.S. Pat. No. 7,115,054, which is incorporated herein by reference. An ISCZ may include, for example, a disbonding layer or other element, mechanism, or space suitable for preventing transfer of shear stresses between neighboring barrel walls. A disbonding layer or other ISCZ preferably further prevents neighboring barrel walls from bonding to each other during curing of, and throughout the life of, the ball bat 10.

The ball bat 10 may have any suitable dimensions. The ball bat 10 may have an overall length of 20 to 40 inches, or 26 to 34 inches. The overall barrel diameter may be 2.0 to 3.0 inches, or 2.25 to 2.75 inches. Typical ball bats have diameters of 2.25, 2.625, or 2.75 inches. Bats having various combinations of these overall lengths and barrel diameters, or any other suitable dimensions, are contemplated herein. The specific preferred combination of bat dimensions is generally dictated by the user of the bat 10, and may vary greatly between users.

The ball striking area of the bat 10 typically extends throughout the length of the barrel 14, and may extend partially into the tapered section 16 of the bat 10. For ease of description, this striking area will generally be referred to as the "barrel" throughout the remainder of the description. A bat barrel 14 generally includes a maximum performance location or "sweet spot," which is the impact location where the transfer of energy from the bat 10 to a ball is maximal, while the transfer of energy to a player's hands is minimal. The sweet spot is generally located at the intersection of the bat's center of percussion (COP) and its first three fundamental nodes of vibration. This location, which is typically about 4 to 8 inches from the free end of the barrel 14, does not move when the bat is vibrating in its first (or fundamental) bending mode.

The barrel regions between the sweet spot and the free end of the barrel 14, and between the sweet spot and the tapered section 16 of the bat 10, do not provide the maximum performance that occurs at the sweet spot of the barrel 14. Indeed, in a typical ball bat, the barrel's performance, or trampoline effect, decreases as the impact location moves away from the sweet spot. Accordingly, the sweet spot generally requires the greatest limitation or reduction of BBCOR to bring the bat within regulatory association limits.

One approach to reducing BBCOR without significantly increasing MOI is to include one or more stiffening elements in the bat barrel, as described, for example, in U.S. Pat. No. 8,298,102, which is incorporated herein by reference. In one embodiment, a stiffening element 22 is positioned in the bat barrel 14, at or near the sweet spot of the barrel 14, to limit or reduce the BBCOR of the barrel 14. The stiffening element 22 may be co-molded with the inner surface of a composite bat barrel, or may be adhesively bonded, welded, or otherwise affixed to the inner surface of a composite or metallic bat barrel. In some embodiments, the stiffening element 22 may optionally be spaced from, and affixed to, the inner surface of the bat barrel 14. In other embodiments, the stiffening element 22 may alternatively be held in place in the barrel via an interference fit. Further, in some embodiments, more than one stiffening element may be positioned in the bat barrel 14.

Any of the stiffening elements described herein, unless otherwise specified, may be made of any suitable stiffening materials. A stiffening element may be made of, for example, aluminum, titanium, or steel; composites of polyester, epoxy, or urethane resins with fibers of carbon, glass, boron, Spectra®, Kevlar®, Vectran®, and so forth, including sheet molding compound or bulk molding compound; or thermoplastics such as ABS, nylon, polycarbonate, acrylic, PVC, Delrin®, and so forth, with or without additive fibers, platelets, and particulates, such as nano-clay, nano-particulates, platelets, or short or long fibers of glass, carbon, and so forth.

While the dimensions and weight of the stiffening elements may vary greatly depending on the requirements of a particular regulatory association or batter, it is generally preferred that they weigh less than one ounce so as to minimize the effect on the bat's MOI. In some applications, however, heavier stiffening elements may be used.

Further, while it is generally preferred that the stiffening elements be positioned at or near the sweet spot of the barrel 14, it may be preferable in some embodiments to locate a stiffening element in other bat regions, such as closer to the handle 12 to limit the increase in MOI resulting from inclusion of the stiffening element. While doing so may necessitate an "over-reduction" in BBCOR at the location of the stiffening or damping element (since the sweet spot will still need to be brought within association performance limits, and a lesser reduction in BBCOR generally occurs at locations spaced from the stiffening or damping element), the tradeoff in substantially reduced MOI may be preferred for certain bats or batters. Thus, depending on the design goals for a particular bat, stiffening elements may be utilized at one or more locations of the ball bat 10.

The inclusion of one or more stiffening elements 22 in the barrel 14, as opposed to significantly thickening a substantial portion of the barrel 14, provides a significant reduction in BBCOR without a substantial increase in the bat's MOI. Surprisingly, inclusion of a single stiffening element 22 can appreciably reduce BBCOR along a substantial length of the bat barrel 14.

Figure 2:
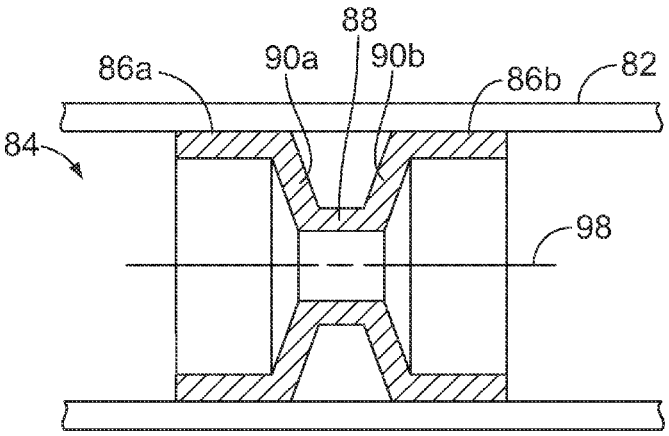
FIG. 2 illustrates a stiffening element in a ball bat, according to one embodiment.

FIG. 2 illustrates a ball bat including one embodiment of a stiffening element 84 that increases barrel stiffness over a substantial length of the barrel. The bat includes a barrel wall 82 that may be of uniform or varying thickness, depending on local stiffness goals. The stiffening element 84 includes two annular base members or radially outer flanges 86*a* and 86*b*, an annular radially inner flange 88, and two web members or webs 90*a* and 90*b* connecting the outer flanges 86*a* and 86*b* to the inner flange 88. The radially outer surfaces of the radially outer flanges 86*a* and 86*b* contact the inner surface of the barrel wall 82. In some embodiments, they may be affixed or otherwise connected to the inner surface of the barrel wall 82.

This "double-web" stiffening element 84 with an elongated inner flange 88 includes more material located toward a centerline 98 of the bat barrel 82 than does a typical single-web design, resulting in a stiffening element 84 with a higher cross-sectional moment of inertia. Further, the centroid of the stiffening element 84 may be located closer to the centerline 98 of the barrel if the radially inner flange 88 is of sufficient length, resulting in increased barrel stiffness relative to a single-web design.

This configuration also increases stiffness over a greater length of the barrel 82 because the radially inner flange 88 is connected at both of its ends by stiffening webs 90*a* and 90*b*. Additionally, smaller diameter pipes or flanges have a higher hoop stiffness than larger diameter pipes or flanges of like material, and the longer the flange 88, the greater the stiffness effect on the barrel. As a result, the double-web stiffening element 84 may be relatively lightweight, which minimizes the overall bat weight and MOI in a manner that is generally not possible with single-web designs. Indeed, a limitation of single-web stiffening elements is that they increase barrel stiffness where the web is located but the overall length of the stiffness zone may be somewhat limited.

The stiffening element 84 may have any suitable dimensions to meet desired stiffness and performance goals. In one embodiment, the radially outer flanges 86*a* and 86*b* are each approximately 0.375 inches long and run parallel to the bat axis 104. The outside diameter of each of the radially outer flanges 86*a* and 86*b* may be designed to fit tightly within a bat barrel. For example, the outer flanges 86*a* and 86*b* may each have an outside diameter of approximately 2.400 inches to fit tightly inside of a typical baseball bat barrel. The connecting webs 90*a* and 90*b* may be angled at approximately 10-45 degrees from a line running perpendicular to the bat's centerline or axis 98. In one embodiment, the connecting webs 90*a* and 90*b* are angled at approximately 15 degrees from such a line (i.e., 105 degrees from the longitudinal axes of the outer flanges 86*a* and 86*b*).

The radially inner flange 88 runs between the radially inner ends of the webs 90*a* and 90*b*. The inner flange 88 may be oriented in the same direction or in substantially the same direction as the outer flanges 86*a* and 86*b* (i.e., parallel or substantially parallel to the centerline 98 of the barrel 82). The inner flange 88 may have a length of approximately 0.10 inches to 0.60 inches. In one embodiment, the inner flange 88 has a length of approximately 0.13 inches.

The radially outer surface of the inner flange 88 may be spaced from the radially outer surface of each outer flange 86*a* and 86*b* (in a direction perpendicular to the barrel's centerline 98) by approximately 0.10-0.40 inches. In one embodiment, this spacing is approximately 0.32 inches. The thickness of the inner flange 88 may be approximately 0.03 inches to 0.150 inches. In one embodiment, the inner flange has a thickness of approximately 0.08 inches. The overall length of the stiffening element 84 in the direction of the barrel's centerline 98 (i.e., the distance between the extreme ends of the outer flanges 86*a* and 86*b*) may be approximately 1.0-2.0 inches. In one embodiment, the stiffening element 84 has a length of approximately 1.25 inches.

As described above, the stiffening element 84 may be made of one or more suitable materials. For example, it may be made of a metal or composite material. Some suitable metals include aluminum and aluminum alloys, as well as light weight metals such as titanium and magnesium. A metal stiffening element 84 may be made via machining, forging, casting, or welding. Some suitable composite materials include fibers of carbon, glass, aramid, flax, boron, ceramic, or nano-based materials. Suitable resins for the composite material may include thermoset resins of epoxy, polyester, phenolic, or vinylester, or thermoplastic resins of polyamide, polyurethane, polypropylene, polyphenylsulfide, or polyehteretherketone.

In one embodiment, a carbon-fiber-reinforced epoxy material, or other fiber-reinforced epoxy material, is used to form the stiffening element 84. The stiffening element 84 may be formed, for example, using carbon-fiber strips preimpregnated with epoxy resin. The strips may have any suitable dimensions and fiber angles. Fiber angles of 90 degrees relative to the centerline 98 or axis of the bat produce the highest effective modulus of the stiffening element. Due to shear loads resulting from barrel compression, however, plies oriented at approximately +/−60 degrees relative to the barrel axis may be desired to adequately transfer stress.

The preimpregnated strips may be rolled into a tubular preform to conform to the dimensions of a mold used to form the stiffening element 84. A typical mold may include two halves with annular protrusions that shape the stiffening element 84. Once formed, the tubular preform is placed in the mold and a bladder is positioned inside the preform. The bladder may be made of silicone rubber or of another material that restricts shifting of the preimpregnated strips. The mold is then closed and heat is applied. As the preform warms up, air pressure is applied inside the bladder. The preform expands to conform to the mold cavity. After the mold cycle is completed, the air pressure is released and the mold is cooled. Once the stiffening element 84 cools, it may be removed from the mold.

Features of the above-described embodiments may be used alone or in combination with one another. Furthermore, the ball bats may include additional features not described herein. While several embodiments have been shown and described, various changes and substitutions may of course be made, without departing from the spirit and scope of the invention. The invention, therefore, should not be limited, except by the following claims and their equivalents.

What is claimed is:

1. A ball bat, comprising:

a substantially hollow barrel having an inner surface;

a handle attached to or integral with the barrel and extending from the barrel in a longitudinal direction; and a stiffening element in the barrel, the stiffening element including:

first and second longitudinally spaced base portions positioned against the inner surface of the barrel;

a first radially inwardly protruding portion extending from an end of the first base portion to a first distal end;

a second radially inwardly protruding portion extending from an end of the second base portion to a second distal end; and a longitudinal portion extending from the first distal end of the first radially inwardly protruding portion to the second distal end of the second radially inwardly protruding portion, wherein the longitudinal portion has a shorter length than either of the first and second base portions.

2. The ball bat of claim 1 wherein the first and second radially inwardly protruding portions are oriented at obtuse angles relative to the first and second base portions, respectively.

3. The ball bat of claim 2 wherein the first and second radially inwardly protruding portions are oriented at angles of approximately 105° relative to the first and second base portions, respectively.

4. The ball bat of claim 1 wherein the longitudinal portion is oriented in the same direction as the first and second base portions.

5. The ball bat of claim 1 wherein the longitudinal portion is oriented in substantially the same direction, but at an angle relative to, the first and second base portions.

6. The ball bat of claim 1 wherein the first and second base portions are affixed to the inner surface of the barrel.

7. The ball bat of claim 1 wherein the stiffening element comprises a fiber-reinforced composite material.

8. The ball bat of claim 1 wherein the stiffening element comprises a metal material.

9. The ball bat of claim 1 wherein the stiffening element is located substantially at a sweet spot of the barrel.

10. The ball bat of claim 1 wherein the ball bat further comprises a tapered section joining the handle to the barrel, wherein the stiffening element is located closer to the tapered section than to a sweet spot of the barrel.

11. The ball bat of claim 1 wherein the longitudinal portion defines a central opening along a centerline of the barrel.

12. A ball bat, comprising:

a substantially hollow barrel having an inner surface;

a handle attached to or integral with the barrel and extending from the barrel in a longitudinal direction; and a stiffening element in the barrel, the stiffening element including:

a first outer flange positioned against the inner surface of the barrel;

a second outer flange positioned against the inner surface of the barrel and spaced longitudinally from the first outer flange;

an inner flange extending longitudinally from a first end to a second end, the inner flange having a length of approximately 0.10 to 0.60 inches;

a first web member extending from an end of the first outer flange to the first end of the inner flange; and a second web member extending from an end of the second outer flange to the second end of the inner flange;

wherein the first and second web members are oriented at obtuse angles relative to the first and second outer flanges, respectively.

13. The ball bat of claim 12 wherein the first and second web members are oriented at angles of approximately 105° relative to the first and second outer flanges, respectively.

14. The ball bat of claim 12 wherein the stiffening element is located substantially at a sweet spot of the barrel.

15. The ball bat of claim 12 wherein the ball bat further comprises a tapered section joining the handle to the barrel, wherein the stiffening element is located closer to the tapered section than to a sweet spot of the barrel.

16. The ball bat of claim 12 wherein the inner flange defines a central opening along a centerline of the barrel.

17. The ball bat of claim 12 wherein the stiffening element comprises a fiber-reinforced composite material.

18. The ball bat of claim 12 wherein the stiffening element comprises a metal material.

19. A ball bat, comprising:

a substantially hollow barrel having an inner surface;

a handle attached to or integral with the barrel and extending from the barrel in a longitudinal direction; and a stiffening element in the barrel, the stiffening element including:

a first outer annular member positioned against the inner surface of the barrel;

a second outer annular member positioned against the inner surface of the barrel and spaced longitudinally from the first outer annular member;

an inner annular member extending longitudinally from a first end to a second end, wherein the inner annular member has a shorter length than either of the first and second outer annular members;

a first member extending from an end of the first outer annular member to the first end of the inner annular member; and a second member extending from an end of the second outer annular member to the second end of the inner annular member.

* * * * *